US009121405B2

(12) United States Patent
Kabir et al.

(10) Patent No.: US 9,121,405 B2
(45) Date of Patent: Sep. 1, 2015

(54) TROCHOIDAL ROTARY DEVICE

(71) Applicant: Cameron International Corporation, Houston, TX (US)

(72) Inventors: Omar M. Kabir, Waller, TX (US); Mark Andrew Patterson, Houston, TX (US); Ronald Wayne Webb, Houston, TX (US)

(73) Assignee: GE Oil & Gas Compression Systems, LLC, Houston, TX (US)

( * ) Notice: Subject to any disclaimer, the term of this patent is extended or adjusted under 35 U.S.C. 154(b) by 87 days.

(21) Appl. No.: 13/674,922

(22) Filed: Nov. 12, 2012

(65) Prior Publication Data

US 2014/0134035 A1 May 15, 2014

(51) Int. Cl.

| | |
|---|---|
| ***F01C 1/02*** | (2006.01) |
| ***F01C 1/063*** | (2006.01) |
| ***F04C 18/00*** | (2006.01) |
| ***F04C 27/00*** | (2006.01) |
| ***F01C 19/00*** | (2006.01) |
| ***F01C 21/08*** | (2006.01) |
| ***F04C 2/22*** | (2006.01) |
| ***F04C 15/00*** | (2006.01) |
| *F04C 2/10* | (2006.01) |

(52) U.S. Cl.

CPC ..... *F04C 18/00* (2013.01); *F01C 19/005* (2013.01); *F01C 21/08* (2013.01); *F04C 2/22* (2013.01); *F04C 15/0007* (2013.01); *F04C 27/00* (2013.01); *F04C 2/10* (2013.01); *F04C 15/0076* (2013.01); *F04C 2230/90* (2013.01)

(58) Field of Classification Search

CPC ..... F01C 1/22; F01C 11/008; F04D 29/023; F04D 23/008; F04C 23/001; F04C 18/22; F02B 53/00; F02G 2250/03

USPC ..... 418/61.2, 139–144

See application file for complete search history.

(56) References Cited

U.S. PATENT DOCUMENTS

| | | | | |
|---|---|---|---|---|
| 2,631,544 | A * | 3/1953 | Wilcox | 418/24 |
| 3,348,529 | A * | 10/1967 | Assum | 418/57 |
| 4,772,189 | A * | 9/1988 | Garside | 418/61.2 |
| 5,259,739 | A | 11/1993 | Coates et al. | |
| 5,431,551 | A * | 7/1995 | Aquino et al. | 418/61.2 |
| 5,769,619 | A * | 6/1998 | Crvelin et al. | 418/61.2 |
| 6,676,385 | B1 * | 1/2004 | Choroszylow et al. | 417/313 |
| 2006/0127264 | A1 * | 6/2006 | Aquino et al. | 418/61.2 |

FOREIGN PATENT DOCUMENTS

| | | |
|---|---|---|
| DE | 3508072 | 9/1986 |
| FR | 2719874 | 11/1995 |
| GB | 719974 | 12/1954 |

OTHER PUBLICATIONS

PCT International Search Report & Written Opinion for PCT/US2013/065997 mailed May 21, 2014.

* cited by examiner

*Primary Examiner* — Hoang Nguyen

(74) *Attorney, Agent, or Firm* — Fletcher Yoder, P.C.

(57) ABSTRACT

Embodiments of the present disclosure are directed toward a system including a trochoidal rotary device. The trochoidal rotary device includes a housing comprising an inner surface, a rotor having at least one bearing recess, a shaft eccentrically mounted to the rotor, wherein the shaft and the rotor are integrated with one another, and at least one bearing disposed between the bearing recess of the rotor and the inner surface of the hollow housing, wherein at least one of the inner surface of the hollow housing, the bearing recess of the rotor, and the at least one bearing comprise a bearing interface comprises a surface treatment.

15 Claims, 4 Drawing Sheets

FIG. 1
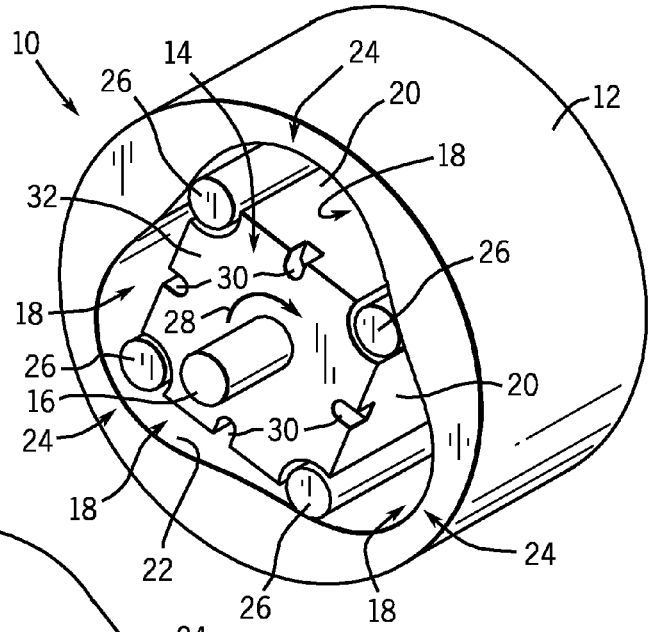
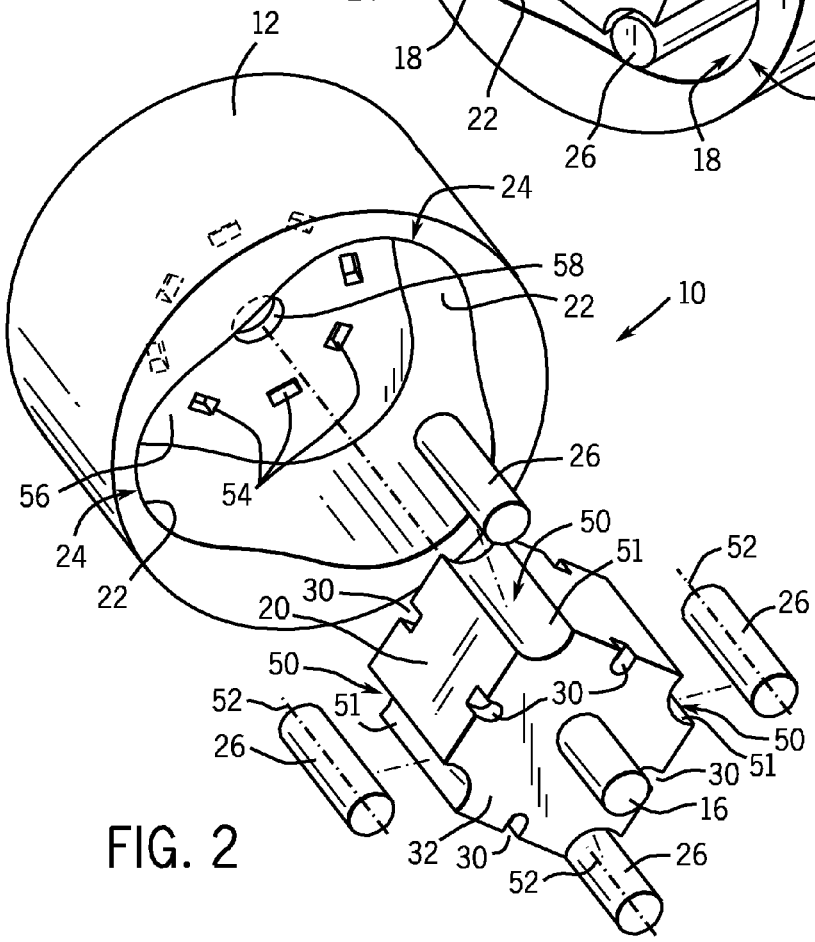
FIG. 2

FIG. 3
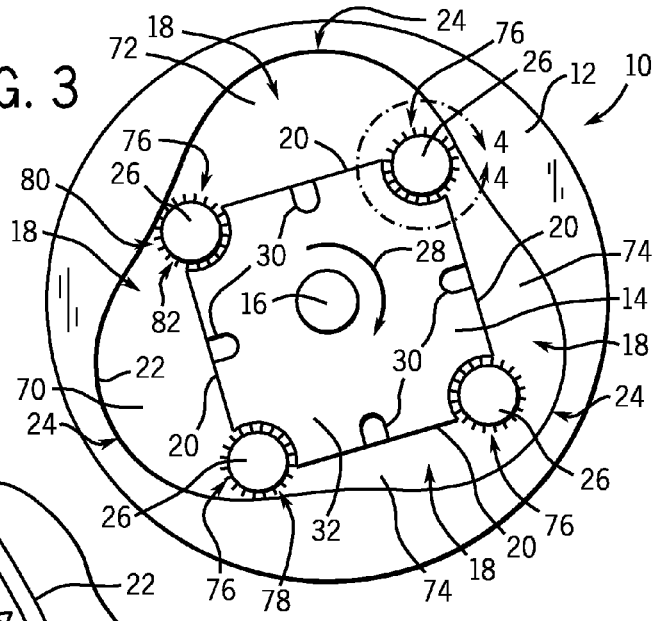
FIG. 4
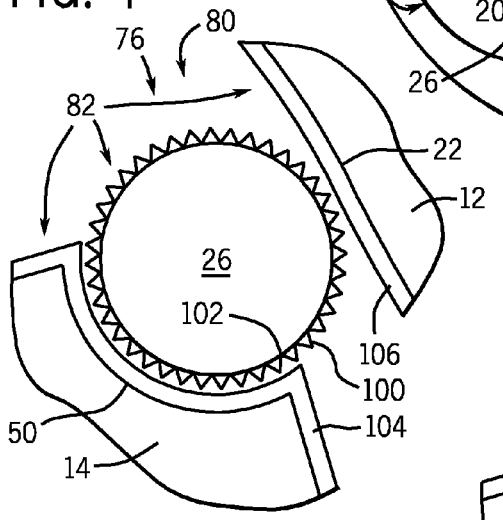
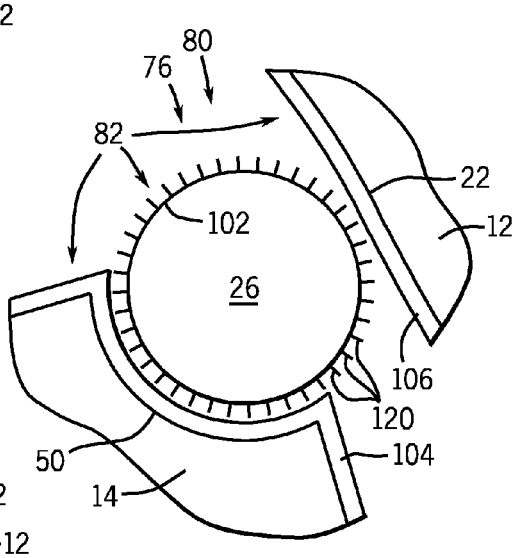
FIG. 5
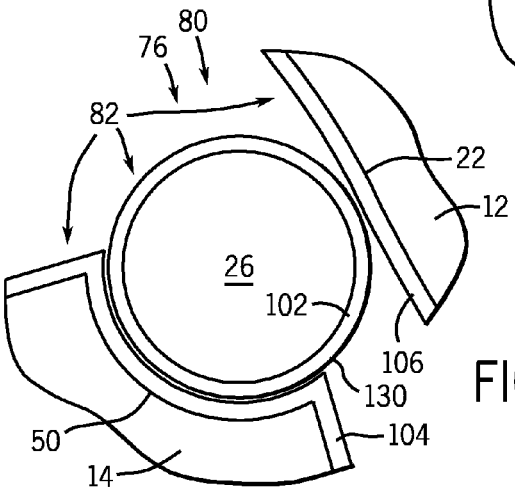
FIG. 6

TROCHOIDAL ROTARY DEVICE

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Rotary devices may be used in a variety of applications, such as compressors, pumps, motors, and so forth. In general, a rotary device includes a housing with a shaft and a rotor disposed within the housing, thereby defining one or more compression chambers between the rotor and an inner surface of the housing. Additionally, the rotary device typically accommodates one or more bearings which allow the rotor to rotate along the inner surface of the housing to achieve compression within the one or more compression chambers. Unfortunately, existing rotary device design may be susceptible to inefficiencies and performance degradation. For example, existing rotary device design may be susceptible to process fluid leakage, undesirable vibrations, component erosion and corrosion, and so forth.

BRIEF DESCRIPTION OF THE DRAWINGS

Various features, aspects, and advantages of the present invention will become better understood when the following detailed description is read with reference to the accompanying figures in which like characters represent like parts throughout the figures, wherein:

FIG. 1 is a perspective view of an embodiment of a trochoidal rotary device, in accordance with aspects of the present disclosure;

FIG. 2 is an exploded perspective view of an embodiment of a trochoidal rotary device, in accordance with aspects of the present disclosure;

FIG. 3 is an axial view of an embodiment of a trochoidal rotary device, in accordance with aspects of the present disclosure;

FIG. 4 is a partial axial view of an embodiment of a trochoidal rotary device, taken within line 4-4 of FIG. 3, illustrating a roller between a rotor and a housing;

FIG. 5 is a partial axial view of an embodiment of a trochoidal rotary device, taken within line 4-4 of FIG. 3, illustrating an a roller between a rotor and a housing;

FIG. 6 is a partial axial view of an embodiment of a trochoidal rotary device, taken within line 4-4 of FIG. 3, illustrating a roller between a rotor and a housing;

DETAILED DESCRIPTION OF SPECIFIC EMBODIMENTS

Figure 7:
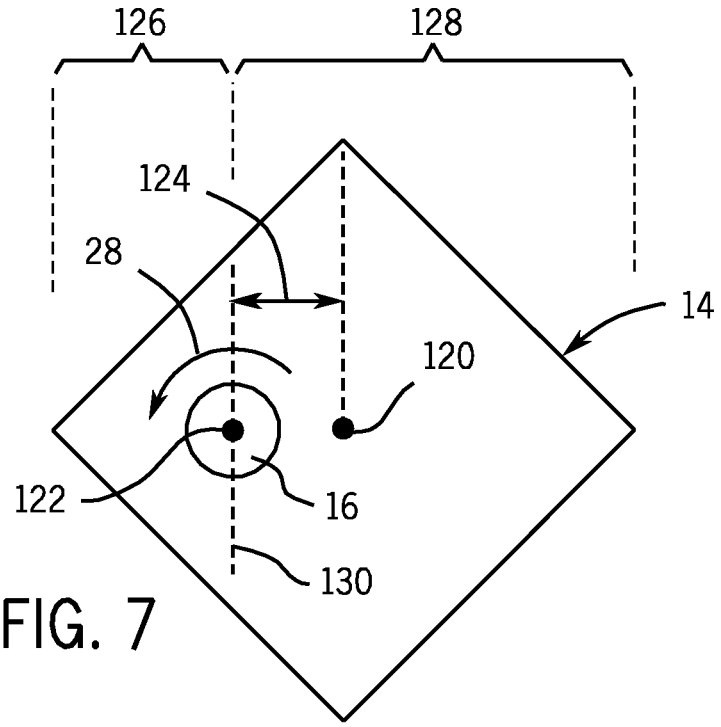
FIG. 7 is a schematic of an embodiment of a rotor for a trochoidal rotary device.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present disclosure are directed toward a trochoidal rotary device with features to improve efficiency, output, and longevity. Specifically, in certain embodiments, the trochoidal rotary device may include a housing with an integrated rotor and shaft. As a result, the shaft and rotor may not include a separate sleeve and/or bearings between the shaft and the rotor, thereby reducing the potential of erosion and corrosion of a sleeve, supporting eccentric rotor, or bearings. Additionally, the rotor of the trochoidal rotary device may be statically and dynamically balanced such that all radial forces at a center of rotation of the rotor are substantially balanced. In this manner, the rotor may have a substantially couple-free design, resulting in reduced vibrations during operation of the trochoidal rotary device. Furthermore, the trochoidal rotary device may include bearings or rollers disposed between the rotor and an inner surface of the housing. More specifically, the rollers, the inner surface of the housing, and/or the rotor may include surface treatments or coatings for improved wear resistance, sealing, and so forth. Additionally, the surface treatments or coatings may provide improved seals between the rollers, the housing, and the rotor. As will be appreciated, the techniques described below may be used with trochoidal rotary devices used in a variety of applications, such as compressors, pumps, motors, generators, and so forth.

Turning now to the drawings, FIG. 1 is a perspective view of an embodiment of a trochoidal rotary device 10 configured to pump or compress a process fluid, such as air, combustion gases, water, liquid fuel, blood, or any other liquid or gas. As illustrated, the trochoidal rotary device 10 includes a housing 12 with a rotor 14 coupled to a shaft 16 disposed within the housing 12. In the illustrated embodiment, a front plate (e.g., front plate 154 shown in FIG. 8) of the housing 12 is removed to expose the rotor 14 within the housing 12. The housing 12, rotor 14, and shaft 16 may be formed from a metal, such as stainless steel or aluminum, a plastic, a ceramic, a composite, or any combination thereof. For example, in an embodiment of the trochoidal rotary device 10 used in a biomedical application, the housing 12, rotor 14, and shaft 16 may each be formed from plastic or other bio-compatible polymer.

In certain embodiments, the rotor 14 and the shaft 16 may be integrated with one another. In other words, the rotor 14 and the shaft 16 may be integrally formed or fixed together as a single piece, such that the rotor 14 and the shaft 16 do not move relative to one another during operation of the trochoidal rotary device 10. For example, the rotor 14 and the shaft 16 may be formed as a single piece using a casting or molding process. In another embodiment, the rotor 14 and the shaft 16 may be fixedly attached to one another by a weld, bolt, pin, or other joining method. In this manner, the trochoidal rotary device 10 may not include a separate sleeve, supporting eccentric rotor, and/or bearings for coupling the rotor 14 to the shaft 16. In this manner, the potential for corrosion and/or erosion of a sleeve or bearings caused by a process fluid may be reduced. The lack of a sleeve or bearings for coupling the rotor 14 to the shaft 16 also simplifies the design of the trochoidal rotary device 10 by reducing the number of components or parts of the trochoidal rotary device 10. Furthermore, as discussed in detail below, the integrated rotor 14 and shaft 16 may have a weight distribution yielding balanced radial forces at the rotational center of the integrated rotor 14 and shaft 16 when the trochoidal rotary device 10 is in operation.

As shown, with the rotor 14 disposed within the housing 12, compression chambers 18 are formed between sides 20 of the rotor 14 and an inner surface 22 of the housing 12. In the illustrated embodiment, the rotor 14 has four similarly-sized sides 20. However, in other embodiments, the rotor 14 may have 3, 5, 6, or more sides 20. Furthermore, the inner surface 22 of the housing 12 has a continuously varying curvature. For example, in the illustrated embodiment, the inner surface 22 of the housing 12 forms three curved recesses 24, where each curved recess 24 is approximately equally spaced from the other curved recesses 24 and each curved recess 24 has approximately the same radius of curvature. In this manner, the inner surface 22 of the housing 12 may have a trochoidal curve.

Moreover, the trochoidal rotary device 10 includes rollers 26 (e.g., bearings) disposed between the rotor 14 and the inner surface 22 of the housing 12. As will be appreciated, the rollers 26, which may be cylindrically shaped, are configured to facilitate and enable the rotation of the rotor 14 within the housing 12, in the manner described below. For example, in certain embodiments, the rollers 26 may be formed from a composite material, plastic, or ceramic. Additionally, as discussed in further detail below, the inner surface 22 of the housing 12 and/or the rollers 26 may have surface treatments to provide improved sealing between the rollers 26 and the inner surface 22 of the housing 12, thereby reducing leakage of a process fluid and improving compression efficiency within the trochoidal rotary device 10 during operation. Furthermore, surface treatments of the rollers 26 and/or the inner surface 22 of the housing 12 may improve the longevity of the trochoidal rotary device 10 by reducing wear and corrosion within the trochoidal rotary device 10.

As will be appreciated, when the rotor 14 is rotated (e.g., in a direction 28) the size of the compression chambers 18 may progressively increase and decrease, thereby pumping or compressing a process fluid. More specifically, a process fluid may enter the compression chambers 18 through recesses 30 formed in a front face 32 of the rotor 14. As illustrated, the recesses 30 are formed at intersections of the front face 32 and the sides 20 of the rotor 14, thereby creating a fluid communication between the front face 32 of the rotor 14 and the compression chambers 18. The rotor 14 may have similar recesses 30 similarly formed in a back face of the rotor 14 through which the process fluid may exit the compression chambers 18 and the trochoidal rotary device 10. In certain embodiments, the recesses 30 formed in the front face 32 of the rotor 14 may be configured to communicate with ports of a front plate (e.g., front plate 154 shown in FIG. 8) that abuts the front face 32 of the rotor 14 and at least partially encloses the compression chambers 18. In other words, as the rotor 14 rotates within the housing 12, a process fluid may flow through ports of a front plate (e.g., front plate 154 shown in FIG. 8) of the housing 12 and enter the compression chambers 18 through the recesses 30 formed in the front face 32 of the rotor 14. Thereafter, as the rotor 14 continues to rotate, the compression chambers 18 may progressively increase and decrease in size, thereby pumping the process fluid through recesses 30 formed in a back face of the rotor 14, which may communicate with ports formed in a back plate of the housing 12.

FIG. 2 is an exploded perspective view of an embodiment of the trochoidal rotary device 10. The illustrated embodiment includes similar elements and element numbers as the embodiment illustrated in FIG. 1. As mentioned above, the rollers 26 are configured to be positioned between the rotor 14 and the housing 12 (i.e., the inner surface 22 of the housing 12). For example, in the illustrated embodiment, the rotor 14 includes roller recesses 50, and each roller recess 50 is configured to support one roller 26. As shown, the roller recesses 50 are formed at intersections of the sides 20 of the rotor 14 and have curved surfaces 51. In this manner, each roller 26 may rotate about a respective axis 52 within a respective roller recess 50. As discussed in detail below, the rollers 26 and/or the roller recesses 50 (e.g., curved surfaces 51) may have a surface treatment to improve rotor 14 performance.

Additionally, in the illustrated embodiment, ports 54 formed in a back plate 56 of the housing are shown. As similarly described above, a process fluid may exit the ports 54 of the housing 12 during operation of the trochoidal rotary device 10. More specifically, as the rotor 14 rotates within the housing 12, the compression chambers 18 formed by the rotor 14 and the housing 12 may progressively increase and decrease in size, thereby pumping a process fluid through the recesses 30 formed in a back face 33 of the rotor 14, which communicate with the ports 54 formed in the back plate 56 of the housing 12. Furthermore, the back plate 56 of the housing 12 includes an aperture 58 configured to support the shaft 16 of the rotor 14 when the trochoidal rotary device 10 is assembled. As will be appreciated, the aperture 58 may be configured to enable rotation of the shaft 16 when the shaft 16 is disposed within the aperture 58.

FIG. 3 is an axial view of an embodiment of the trochoidal rotary device 10, illustrating assembled components of the trochoidal rotary device 10. The illustrated embodiment includes similar elements and element numbers as the embodiment shown in FIG. 1. As shown, the compression chambers 18 of the trochoidal device 10 are in various stages of compression resulting from the rotation of the rotor 14 within the housing 12. For example, a first compression chamber 70 and a second compression chamber 72 are in stages of expansion. In other words, the first and second compression chambers 70 and 72 are increasing in size, thereby allowing a process fluid to flow into the first and second compression chambers 70 and 72. Specifically, as described above, the process fluid may flow into the first and second compression chambers 70 and 72 through the recesses 30 formed in the front face 32 of the rotor 14, which communicate with ports in a front plate (e.g., front plate 154 shown in FIG. 9) of the housing 12.

Conversely, a third compression chamber 74 is in a stage of compression, as illustrated. In other words, the size of the third compression chamber 74 is decreasing as the rotor 14 rotates in the direction 28. In this manner, a process fluid within the third compression chamber 74 is compressed and pumped through the trochoidal rotary device 10 when the recesses 30 formed in a back face of the rotor 14 communicate with the ports 54 formed in the back plate 56 of the housing 12.

As discussed above, the rollers 26 are disposed between the rotor 14 and the inner surface 22 of the housing 12. Specifically, the rollers 26 rotate within the roller recesses 50 of the rotor 14 and travel along the inner surface 22 of the housing 12 as the rotor 14 rotates within the housing 12. As will be appreciated, seals 76 may be formed between the inner surface 22 of the housing 12, the rollers 26, and the roller recesses 50 of the rotor 14 to block a process fluid from leaking within the trochoidal rotary device 10. In other words, the seals 76 may be configured to block a process fluid from leaking from one compression chamber 18 to another (e.g., from the third compression chamber 74 to the first compression chamber 70). For example, in the illustrated embodiment, when the process fluid is being compressed in the third compression chamber 74, a first seal 76, 78 may block the process fluid from leaking into the first compression chamber 70. In this manner, process fluid displacement loses due to process fluid leakage may be reduced, and compression efficiency may be increased.

As discussed below, an interface 80 (e.g., a bearing interface) between the inner surface 22 of the housing 12, the rollers 26, and/or the roller recesses 50 of the rotor 14 may have one or more surface treatments or coatings 82 to provide improved performance of the trochoidal rotary device 10. In other words, the inner surface 22 of the housing 12, the rollers 26, and/or the roller recesses 50 of the rotor 14 may have one or more surface treatments or coatings 82. Specifically, the surface treatments or coatings 82 of the inner surface 22 of the housing 12, the rollers 26, and/or the roller recesses 50 may be configured to improve the performance of the seals 76 formed by the inner surface 22 of the housing 12, the rollers 26, and the roller recesses 50 of the rotor 14. Additionally, the surface treatments or coatings 82 may protect the inner surface 22 of the housing 12, the rollers 26, and/or the roller recesses 50 of the rotor 14 from corrosion or erosion caused by a process fluid. For example, the surface treatments or coatings 82 of the inner surface 22 of the housing 12, the rollers 26, and/or the roller recesses 50 of the rotor 14 may form labyrinth seals, babbitted seals, brush seals, or other improved seals between the rotor 14 and the inner surface 22 of the housing 12.

FIGS. 4-6 illustrate embodiments of the seal 76 and the interface 80 formed between the roller 26, the rotor 14 and the inner surface 22 of the housing 12. More specifically, the inner surface 22 of the housing 12, the rollers 26, and/or the roller recesses 50 of the rotor 14 include one or more surface treatments or coatings 82 to form improved seals 76 between the rotor 14 and the inner surface 22 of the housing 12. For example, FIG. 4 is an embodiment of the seal 76, where the seal 76 is a labyrinth seal. Specifically, the inner surface 22 of the housing 12, the roller 26, and the roller recess 50 of the rotor 14 have surface treatments or coatings 82 to create a tortuous path (e.g., labyrinth) between the roller 26, the inner surface 26 of the housing 12, and the roller recess 50. For example, the roller 26 has a grooved or notched surface. In other words, the roller 26 has gear-teeth 100 coupled to a circumferential surface 102 of the roller 26, which may improve the sealing capability of the seal 76. In certain embodiments, the gear-teeth 100 may be formed from a tin, lead, steel, titanium, or other metallic material. Furthermore, the gear-teeth 100 may be integrated with the roller 26, or the gear-teeth surface 100 may be a separate component that is attached to the circumferential surface 102 of the roller 26. As will be appreciated, the gear-teeth 100 may create a longer flow path along and around the roller 26, which may block or reduce leakage of a process fluid being compressed within the compression chambers 18. Additionally, in the illustrated embodiment, the roller recess 50 of the rotor 14 has a surface coating 104, and the inner surface 22 of the housing 12 has a surface coating 106. The surface coatings 104 and 106 may be babbitted coatings, wear resistant coatings, chemical resistant coatings, ceramic coatings, polymeric coatings, or other protective coatings. In this manner, the seal 76 (e.g., the inner surface 22 of the housing 12, the rollers 26, and/or the roller recesses 50 of the rotor 14) and the trochoidal rotary device 10 may experience improved longevity and sealing performance.

FIG. 5 is an embodiment of the seal 76 and the interface 80 formed between the roller 26, the rotor 14 and the inner surface 22 of the housing 12. In the illustrated embodiment, the seal 76 is a brush-type seal. Specifically, the roller 26 includes bristles 120 coupled to the circumferential surface 102 of the roller 26. For example, the bristles 120 may be wire bristles (e.g., formed from a metal, such as tin or steel), ceramic bristles, polymeric bristles, or other bristles. As similarly discussed above, the bristles 120 may be integrated with the roller 26, or the bristles 120 may be separate components coupled to the circumferential surface 102 of the roller 26. In operation, the bristles 120 may serve to block or reduce the flow of a process fluid through the seal 76, thereby reducing leakage of the process fluid between compression chambers 18. Additionally, in the illustrated embodiment, the roller recess 50 of the rotor 14 has the surface coating 104, and the inner surface 22 of the housing 12 has the surface coating 106. As discussed above, the surface coatings 104 and 106 may be babbitted coatings, wear resistant coatings, chemical resistant coatings, ceramic coatings, polymeric coatings, or other protective coatings. In this manner, the seal 76 (e.g., the inner surface 22 of the housing 12, the roller 26, and/or the roller recess 50 of the rotor 14) and the trochoidal rotary device 10 may experience improved longevity and sealing performance.

FIG. 6 is an embodiment of the seal 76 and the interface 80 formed between the roller 26, the rotor 14 and the inner surface 22 of the housing 12. In the illustrated embodiment, the circumferential surface 102 of the roller 26 includes a surface coating 130. In certain embodiments, the surface coating 130 may be a babbitted coating. As will be appreciated, a babbitted coating may be a multi-metal composite. Specifically, the babbitted coating may include a hard metal component (e.g., a crystalline material) and a soft metal component (e.g., a matrix material). The babbitted coating (e.g., surface coating 130) may increase the longevity of the roller 26 and the components which contact the roller 26 during operation of the trochoidal rotary device 10 (e.g., the roller recess 50 of the rotor 14 and the inner surface 22 of the housing 12). Specifically, the babbitted coating (e.g., surface coating 130) may reduce galling (e.g., adhesive wear) between the roller 26 and the roller recess 50 of the rotor 14 and the inner surface 22 of the housing 12. In other embodiments, the surface coating 130 may be another wear resistant coating, chemical resistant coating, ceramic coating, polymeric coating, or the like.

Additionally, in the illustrated embodiment, the roller recess 50 of the rotor 14 has the surface coating 104, and the inner surface 22 of the housing 12 has the surface coating 106. As discussed above, the surface coatings 104 and 106 may be wear resistant coatings, chemical resistant coatings, ceramic coatings, polymeric coatings, or other protective coatings. In this manner, the seal 76 (e.g., the inner surface 22 of the housing 12, the roller 26, and/or the roller recess 50 of the rotor 14) and the trochoidal rotary device 10 may experience improved longevity. For example, the components of the trochoidal rotary device 10 may experience reduced corrosion and erosion (e.g., from process fluids). Additionally, the sealing properties of the seals 76 may be improved.

FIG. 7 is a schematic of an embodiment of the rotor 14, illustrating shaft 16 integrated with the rotor 14. Additionally, the shaft 16 is eccentrically coupled to the rotor 14. As will be appreciated, the illustrated integral rotor 14 and shaft 16 have an eccentric configuration, because a geometric center 120 of the rotor 14 and the axis of rotation of the rotor 14 (e.g., a center 122 of the shaft 16 about which the rotor 14 rotates) are offset by a distance 124 (e.g., an eccentric distance). As previously discussed, the rotor 14 and shaft 16 are integrated together as one piece, e.g., integrally formed for fixed together. In this manner, the rotor 14 does not include a separate sleeve, supporting eccentric rotor, and/or bearings for coupling the rotor 14 to the shaft 16. In this manner, the potential for corrosion and/or erosion of a sleeve or bearings caused by a process fluid may be reduced. Additionally, the design of the rotor 14, the shaft 16, and the trochoidal rotary device 10 may be simplified by reducing the number of parts.

Furthermore, as mentioned above, the integrated rotor 14 and shaft 16 may have a weight distribution configured to yield a balance of radial forces at a center of rotation (e.g. about the center 122 of the shaft 16) during operation of the trochoidal rotary device 10. In other words, the integrated rotor 14 and shaft 16 may be statically and dynamically balanced without changing the geometric shape of the rotor 14. For example, in the illustrated embodiment, the rotor 14 includes a first portion 126 and a second portion 128 generally divided by an axis 130 extending laterally through the center 122 of the shaft 16 (e.g., through the center of rotation of the rotor 14). In other embodiments, the axis 130 dividing the first portion 126 and the second portion 126 of the rotor 14 may extend through other sections of the rotor 14.

The weight of the first portion 126 and the weight of the second portion 128 may be selected to effectuate the static and dynamic balancing of the integrated rotor 14 and shaft 16 when the trochoidal rotary device 10 is in operation. For example, material from an interior of the first portion 126 and/or the second portion 128 of the rotor 14 may be removed. In this way, the exterior geometry of the rotor 14 is unchanged, but the weight distribution of the rotor 14 may be modified. In other embodiments, the first portion 126 and the second portion 128 of the rotor 14 may be formed from different materials (e.g., materials having different densities). For example, the first and second portions 126 and 128 may be formed from one or more composites, plastics, ceramics, or any combination thereof. Similarly, the shaft 16 may be formed from a composite, plastic, ceramic, or other material, which may be different from the materials used to form the first and second portions 126 and 128 of the rotor 14. Moreover, while the first and second portions 126 and 128 of the rotor 14 and the shaft 16 may be formed from different materials, the first and second portions 126 and 128 of the rotor 14 may still be integrated with the shaft 16 and one another to form the integrated rotor 14 and shaft 16.

As will be appreciated, the statically and dynamically balanced design of the integrated rotor 14 and shaft 16 may yield improved performance of the trochoidal rotary device 10. More specifically, the statically and dynamically balanced design of the integrated rotor 14 and shaft 16 may enable the balancing of some or all radial forces at the center 122 of rotation of the integrated rotor 14 and shaft 16. In this manner, the rotor 14, the shaft 16, and the trochoidal rotary device 10 may have a couple free design in the radial direction. Additionally, the vibration levels of the trochoidal rotary device 10 may be reduced. As a result, the longevity and useful life of the trochoidal rotary device 10 may be increased.

Figure 8:
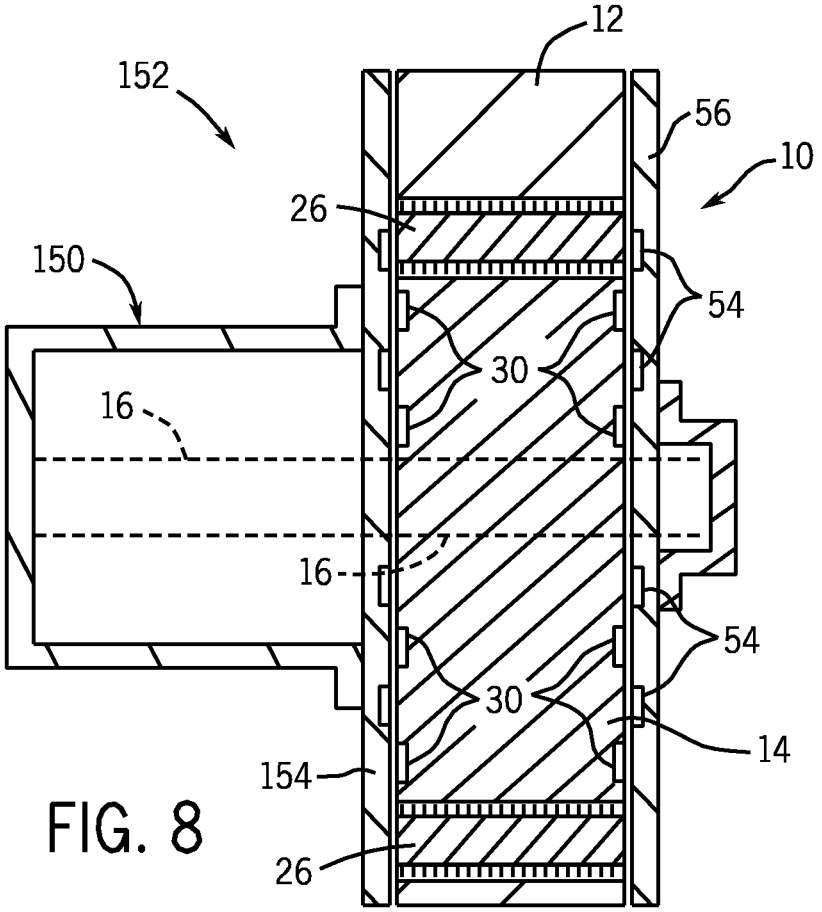
FIG. 8 is a side view of an embodiment of a trochoidal rotary device coupled to a motor.
Figure 9:
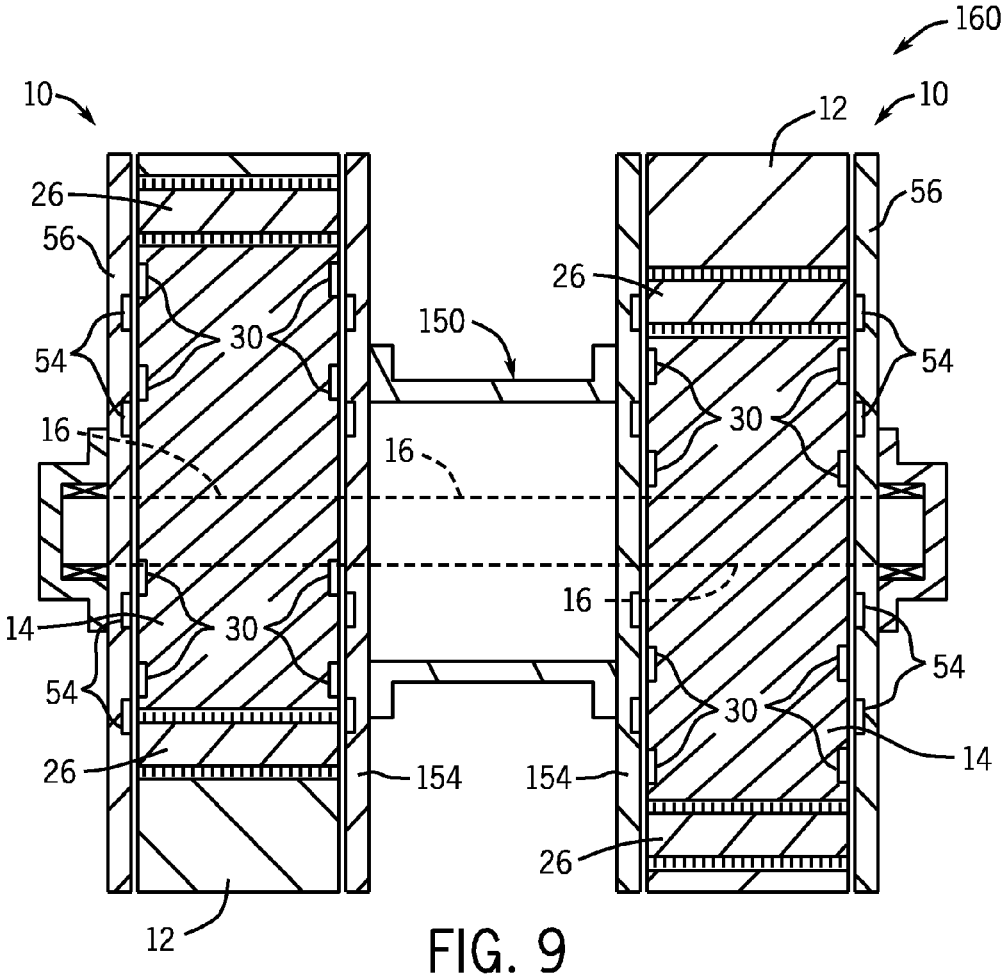
FIG. 9 is a side view of an embodiment of two trochoidal rotary devices coupled to a motor.

FIGS. 8 and 9 illustrate embodiments of the trochoidal rotary device 10 coupled to a motor 150. For example, FIG. 8 is a schematic of a system 152 including one trochoidal rotary device 10 coupled to the motor 150 (e.g., single stage design). In the illustrated embodiment, the motor 150 is coupled to a front plate 154 of the trochoidal rotary device 10. In certain embodiments, the motor 150 may be a hermetically sealed motor, such as a brushless DC motor. As shown, the shaft 16 extends into the motor 150, and the motor 150 is configured to rotate the shaft 16. In other embodiments, the shaft 16 may couple to a separate shaft of the motor 150. In this manner, the motor 150 drives the operation of the trochoidal rotary device 10 in order to pump or compress a process fluid (e.g., a liquid or gas). For example, the process fluid may be a coolant, a fuel, a lubricant, a cleansing fluid, a biological fuel (e.g., blood or medicine), or other fluid. Additionally, in embodiments where the motor 150 is a hermetically sealed motor, the process fluid may be used to lubricate the motor 150 and/or the bearing surfaces of the trochoidal rotary device 10 (e.g., the inner surface 22 of the housing 12, the rollers 26, and so forth). Similarly, FIG. 9 is a schematic of a system 160 including two trochoidal rotary devices 10 coupled to the motor 150 (e.g., double stage design). In the illustrated embodiment, the two trochoidal rotary devices 10 are positioned on opposite sides of the motor 150. However, in other embodiments, the two trochoidal rotary devices 10 may be positioned on the same side of the motor 150, i.e., in a stacked configuration.

Figure 10:
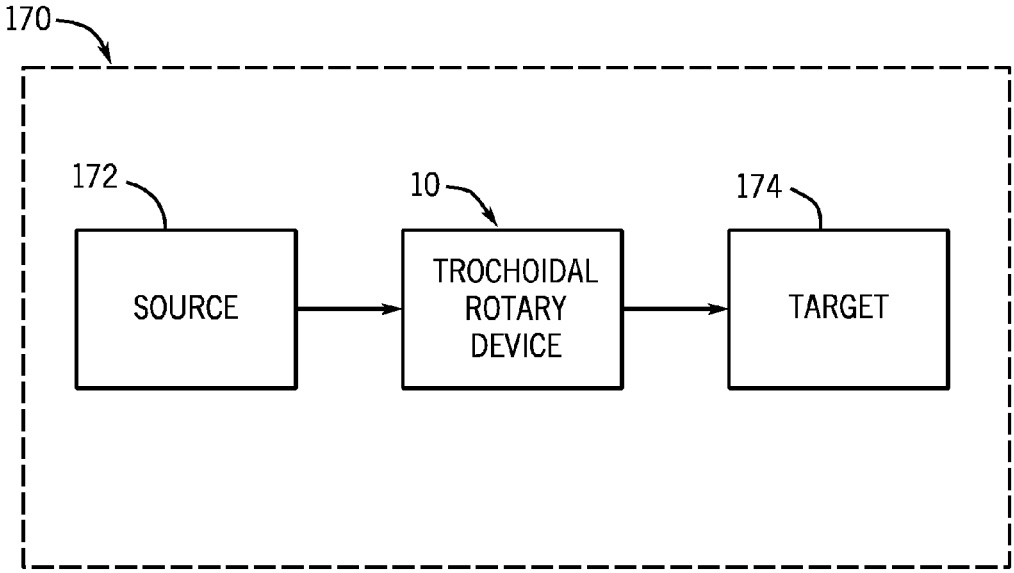
FIG. 10 is a schematic of a system including a trochoidal rotary device.

FIG. 10 is a schematic of a system 170 which includes the trochoidal rotary device 10. The system 170 may be any of a variety of applications which may require the pumping or compression of a process fluid. In other words, the system 170 includes the trochoidal rotary device 10 configured to pump or compress a process fluid from a source 172 to a target 174. For example, the system 170 may be an artificial heart, e.g., an artificial human heart. In such an embodiment, the trochoidal rotary device 10 may be configured to pump a process fluid, such as blood. More specifically, the source 172 may be veins within a human body which direct blood to the trochoidal rotary 10, and the target 174 may be arteries of a human body to which the blood is pumped by the trochoidal rotary device 10. In another embodiment, the system 170 may be an oil and gas or other mineral recovery system. In such an embodiment, the trochoidal rotary device 10 may be configured to pump or compress a process fluid, such as a hydraulic fluid, lubricant, chemical fluid, and so forth. In other embodiments, the system 170 may be a fuel system, an engine driven system, a vehicle, etc.

As will be appreciated, the trochoidal rotary device 10 included in the system 170 may include one or more of the features described above. For example, the trochoidal rotary device 10 may include the integrated rotor 14 and shaft 16, and the rotor 14 may be statically and dynamically balanced to yield balanced radial forces during operation of the trochoidal rotary device 10. Furthermore, the trochoidal rotary device 10 may include improved seals 76 between the rollers 26 and the inner surface 22 of the housing 12 and the rotor 14. For example, the rollers 26, the inner surface 22 of the housing 12, and/or the roller recesses 50 of the rotor 14 may include surface treatments or coatings 82 to improve the sealing function of the seals 76. The surface treatments or coatings 82 may also help protect the components of the trochoidal rotary device 10 from corrosion or erosion caused by a process fluid, thereby increasing the longevity of the trochoidal rotary device 10.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a trochoidal rotary device, comprising:

a housing;

a rotor body disposed within the housing; and a shaft coupled to the rotor body, wherein the shaft is eccentrically mounted to the rotor body, the shaft and the rotor body are integrally formed as one piece, the rotor body is statically and dynamically balanced about a center of rotation of the rotor body, the rotor body comprises a first material and a second material, the first material is disposed only on a first side of the shaft, the second material is disposed only on a second side of the shaft, and the first material and the second material have different densities.

2. The system of claim 1, comprising at least one bearing disposed between a bearing recess of the rotor body and an inner surface of the housing, wherein the at least one bearing is configured to enable rotation of the rotor body within the housing.

3. The system of claim 2, wherein the at least one bearing comprises gear teeth disposed on an outer surface of the at least one bearing.

4. The system of claim 2, wherein the at least one bearing comprises a plurality of bristles disposed on an outer surface of the at least one bearing.

5. The system of claim 2, wherein the bearing recess of the rotor body, the inner surface of the housing, or both comprises a babbitted surface.

6. The system of claim 2, wherein at least one of the at least one bearing, the bearing recess of the rotor body, and the inner surface of the housing comprises a surface coating.

7. The system of claim 2, wherein the at least one bearing comprises a coating disposed on an outer surface of the at least one bearing, wherein the coating is a ceramic coating or a babbitted coating.

8. The system of claim 2, wherein the inner surface of the housing comprises a ceramic coating.

9. The system of claim 1, wherein the rotor body is at least partially hollow.

10. A system, comprising:

a trochoidal rotary device, comprising:

a hollow housing comprising an inner surface having a babbitted coating;

a rotor comprising a plurality of bearing recesses disposed within the housing; and a plurality of bearings, each of the plurality of bearings disposed between a respective bearing recess of the rotor and the inner surface of the hollow housing, wherein the plurality of bearings are configured to enable rotation of the rotor within the housing.

11. The system of claim 10, wherein each of the plurality of bearings comprises gear teeth or bristles disposed on an outer surface of each of the plurality of bearings.

12. The system of claim 10, comprising a shaft eccentrically coupled to the rotor, wherein the shaft and the rotor are integrated with one another.

13. The system of claim 10, wherein the rotor is statically and dynamically balanced about a center of rotation of the rotor.

14. The system of claim 10, comprising an artificial heart, wherein the trochoidal rotary device is configured to pump blood through the artificial heart.

15. The system of claim 1, comprising an artificial heart, wherein the trochoidal rotary device is configured to pump blood through the artificial heart.

* * * * *